US007900326B2

(12) United States Patent
Elhaj

(10) Patent No.: US 7,900,326 B2
(45) Date of Patent: Mar. 8, 2011

(54) BROKEN HEART SHAPED COFFIN

(76) Inventor: Antoine Elhaj, Sandusky, OH (US)

( * ) Notice: Subject to any disclaimer, the term of this patent is extended or adjusted under 35 U.S.C. 154(b) by 150 days.

(21) Appl. No.: 12/390,400

(22) Filed: Feb. 20, 2009

(65) Prior Publication Data

US 2010/0212123 A1 Aug. 26, 2010

(51) Int. Cl.
*A61G 17/00* (2006.01)

(52) U.S. Cl. ..... 27/2; 27/1; 27/12; 27/17; 27/27

(58) Field of Classification Search ..... 27/1, 2, 27/35, 14, 16, 17, 27, 12; 52/128, 134, 136; D99/1–3, 5; 220/23.2, 23.4, 23.83
See application file for complete search history.

(56) References Cited

U.S. PATENT DOCUMENTS 1,661,377 A * 3/1928 Lutz ..... 27/13
1,840,675 A * 1/1932 Letzig ..... 27/2
2,735,157 A * 2/1956 Hotchkiss et al. ..... 27/12
3,348,280 A * 10/1967 Myers ..... 27/2
3,581,452 A * 6/1971 Jalbert ..... 52/133
3,898,718 A * 8/1975 Eubank ..... 27/35
4,868,957 A * 9/1989 Rojdev ..... 27/17
4,993,129 A * 2/1991 Underwood et al. ..... 27/12
5,231,741 A * 8/1993 Maguire ..... 27/12
6,725,510 B1 * 4/2004 Clyburn ..... 27/12
D509,637 S * 9/2005 Wozniak ..... D99/5
D515,267 S * 2/2006 Wozniak ..... D99/5
D543,005 S * 5/2007 Pertz ..... D99/5
D611,675 S * 3/2010 Elhaj ..... D99/5
7,703,186 B1 * 4/2010 Williamson ..... 27/2
D622,024 S * 8/2010 School ..... D99/5
2010/0043187 A1 * 2/2010 Steuer et al. ..... 27/1
2010/0212125 A1 * 8/2010 Elhaj ..... 27/27
2010/0212355 A1 * 8/2010 Elhaj ..... 63/1.14
2010/0269317 A1 * 10/2010 Elhaj ..... 27/4
2010/0293768 A1 * 11/2010 Elhaj ..... 27/35

* cited by examiner

*Primary Examiner* — William L. Miller
(74) *Attorney, Agent, or Firm* — Ronald J. Koch

(57) ABSTRACT

A coffin with a removable 2 piece cover that accommodates bodies of differing lengths having, within an enclosure, a 2 piece platform that adjusts so as to allow the body to form a v-shape by bending the body at the hip whereby the longitudinal length of the body can be adjusted.

10 Claims, 14 Drawing Sheets

BROKEN HEART SHAPED COFFIN

BACKGROUND AND SUMMARY

The present invention relates generally to coffins and specifically to coffins having unique shapes and systems and methods for housing bodies in coffins. The terms casket and coffin as used herein are interchangeable.

One embodiment of a coffin that accommodates bodies of differing lengths comprises, within an enclosure, a 2 piece platform that adjusts so as to allow the body to form a v-shape by bending the body at the hip whereby the longitudinal length of the body can be adjusted. This is advantageous over conventional coffins because larger bodies can be accommodated by the same coffin without having to special order one.

One of skill in the art would appreciate that the size of the coffin will be proportional to the size of common vaults or Sarcophagi that the coffins are placed in, and that the size can be varied somewhat without compromising the spirit of the invention. Accordingly, some sizes are in the range 24 to 26 inches high×84 to 87 inches long and 24 to 36 inches wide.

In one embodiment, a pair of complementary coffins are provided, each comprising: a curved bottom surface and two vertical side walls attached to each side of the curved bottom surface so as to form a container with an opening, a removable cover having upper and lower surfaces and that are attachable to the opening adjacent the lower surface whereby the container can be sealed. The upper surfaces of the removable covers of the coffins have complementary jagged profiles whereby they can be fitted together, in combination with the coffins, to form essentially a heart shape as viewed from a side. The general heart shape can be realized using various curvatures (FIGS. 4, 5).

In general, the curved bottom surface has the shape of one half of a heart shape and the top profile of the coffin has a jagged shape to resemble a rent or torn heart—hence a broken heart shape. Two such coffins may be placed such that the arrangement resembles a whole heart shape. A coffin in the shape of a heart is advantageous in that it the curved lower surface allows positioning a body in a V-shape whereas convention rectangular caskets having flat bottom surfaces are less suited. Moreover, such a shape is less intimidating for children to look at. A married couple can each be buried in one half of the heart shape knowing that the two halves shall be reunited for eternal rest. Additionally, one of the two can be inverted resulting in the final resting place of the coffins is actually in a heart shape.

One of skill in the art would appreciate that the present invention can be made of the same materials (e.g. wood, metal, fiberglass, composites, etc.) that conventional coffins are made of.

Various ways of providing a movable cover are possible. For instance, the cover can be completely removable or alternatively have hinges whereby the cover may be opened and closed from either the sides or ends or some combination thereof. A completely removed cover makes it easier to load and unload bodies. In one embodiment, carrying handles are affixed to each of the vertical sides.

DETAILED DESCRIPTION

Figure 1:
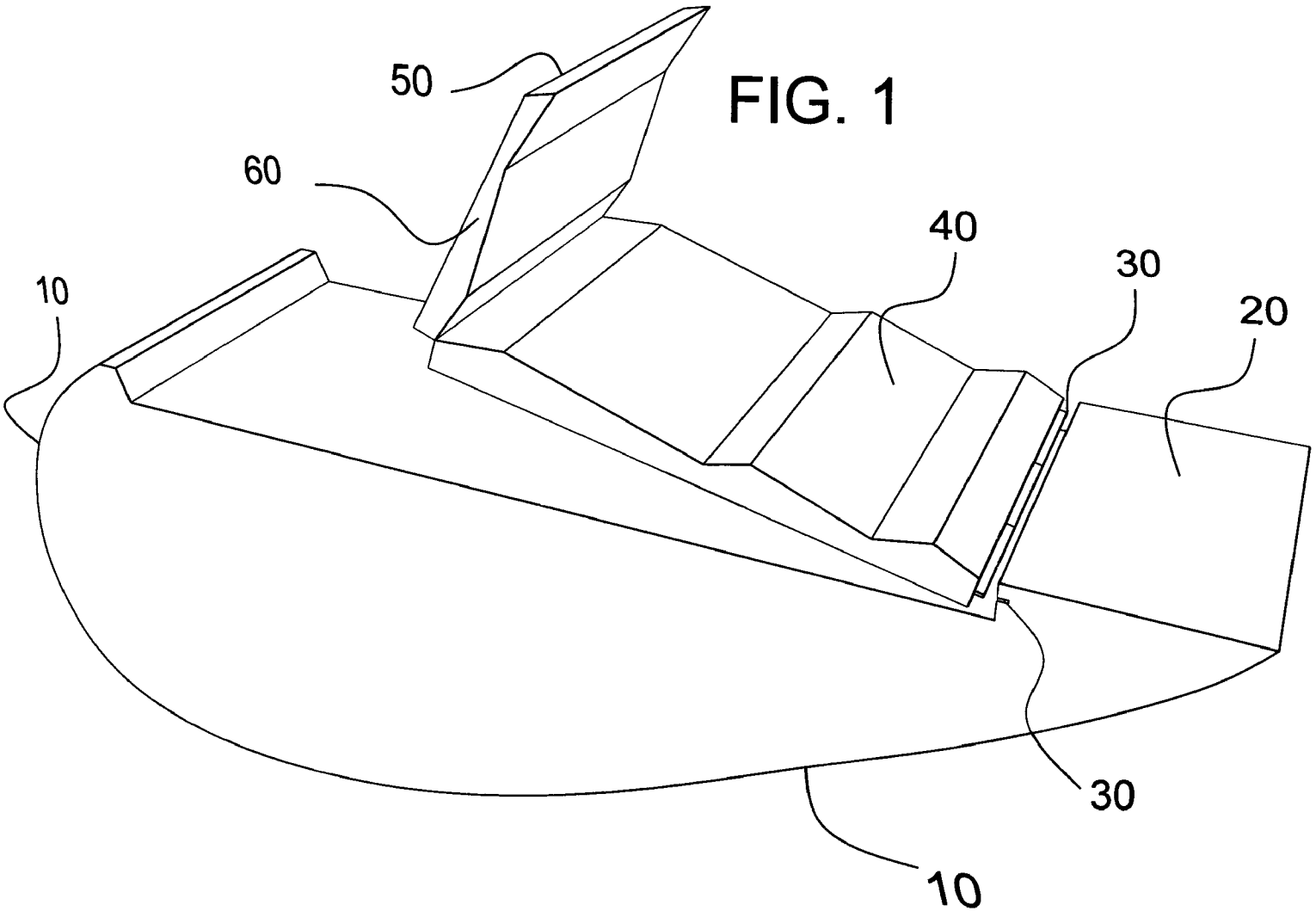
FIG. 1 depicts a perspective view of the invention
Figure 2:
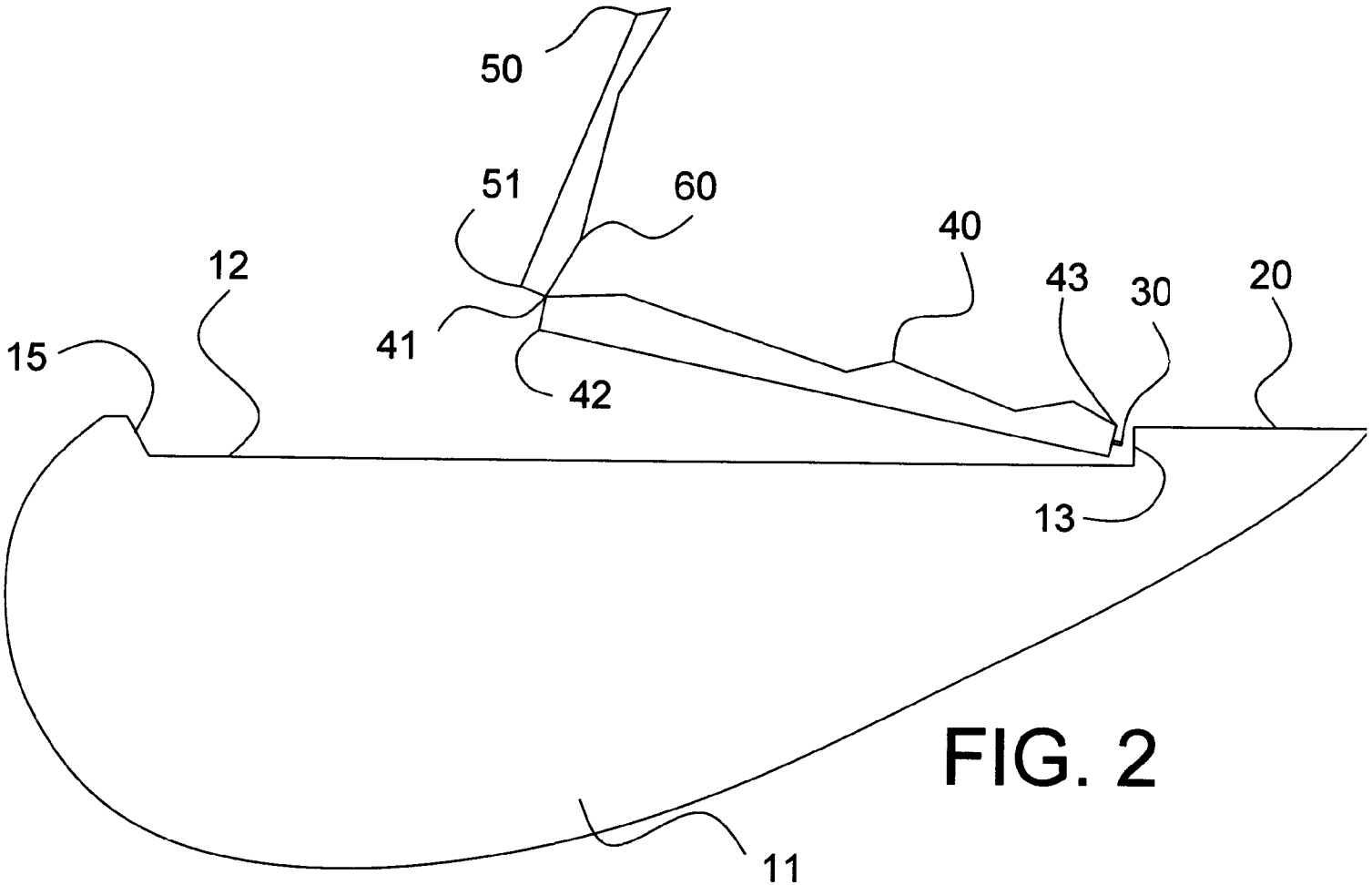
FIG. 2 depicts a side view of the invention

One embodiment of the invention comprises: a curved bottom surface 10, two vertical side walls 11 attached to each side of the curved bottom surface so as to form a container having an opening 12, a removable cover that is attachable to the opening 12 whereby the container can be sealed, a first gasket is attached to the periphery of the opening 12, a second gasket for sealing the interface 41 of the first and second cover portions 40, 60, and first and second cooperative support platforms 71, 72. One of skill in the art would appreciate that the gasket is not essential but highly preferred to isolate the contents from the surrounding environment.

Figure 3:
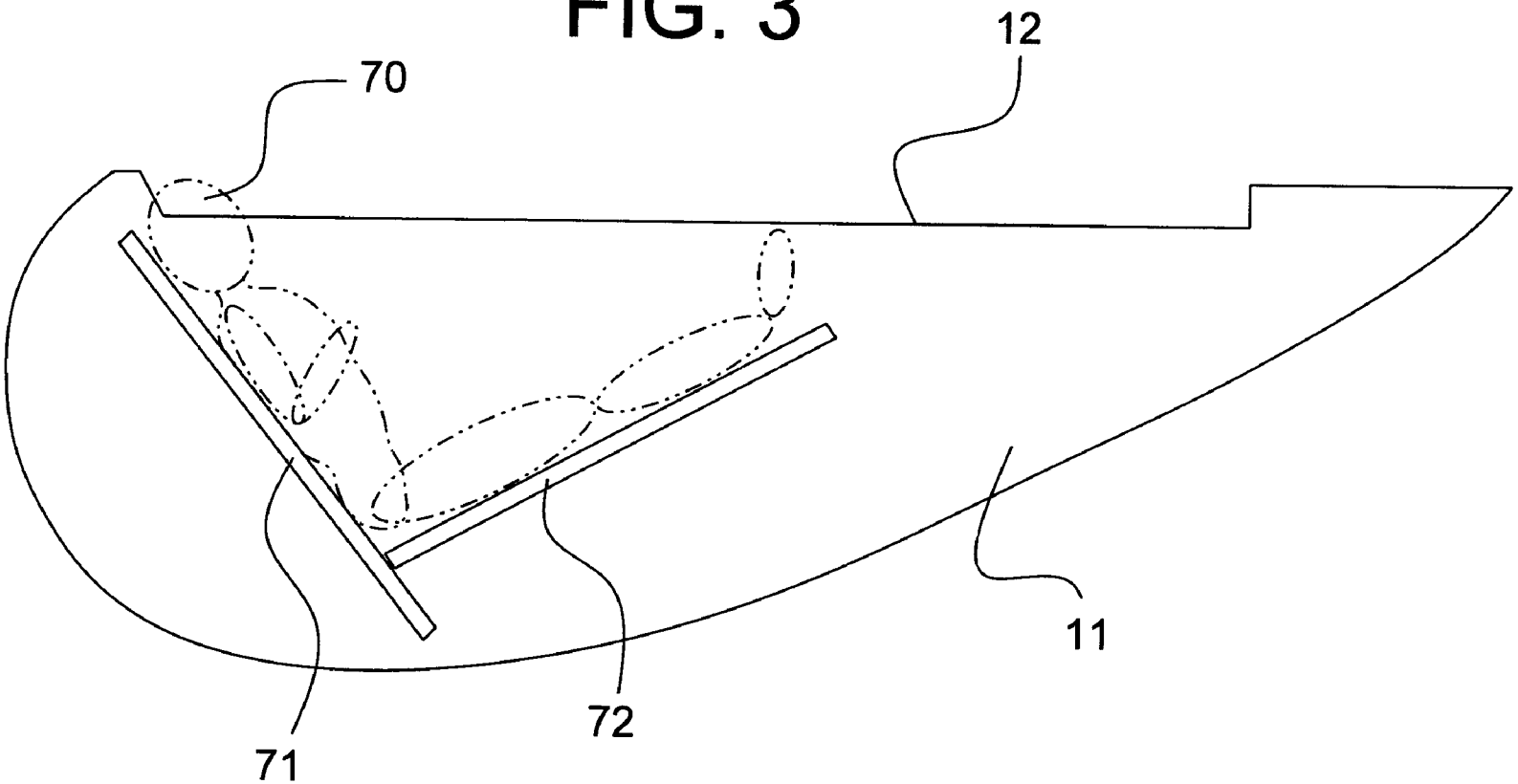
FIG. 3 depicts a side view of the invention
Figure 4:
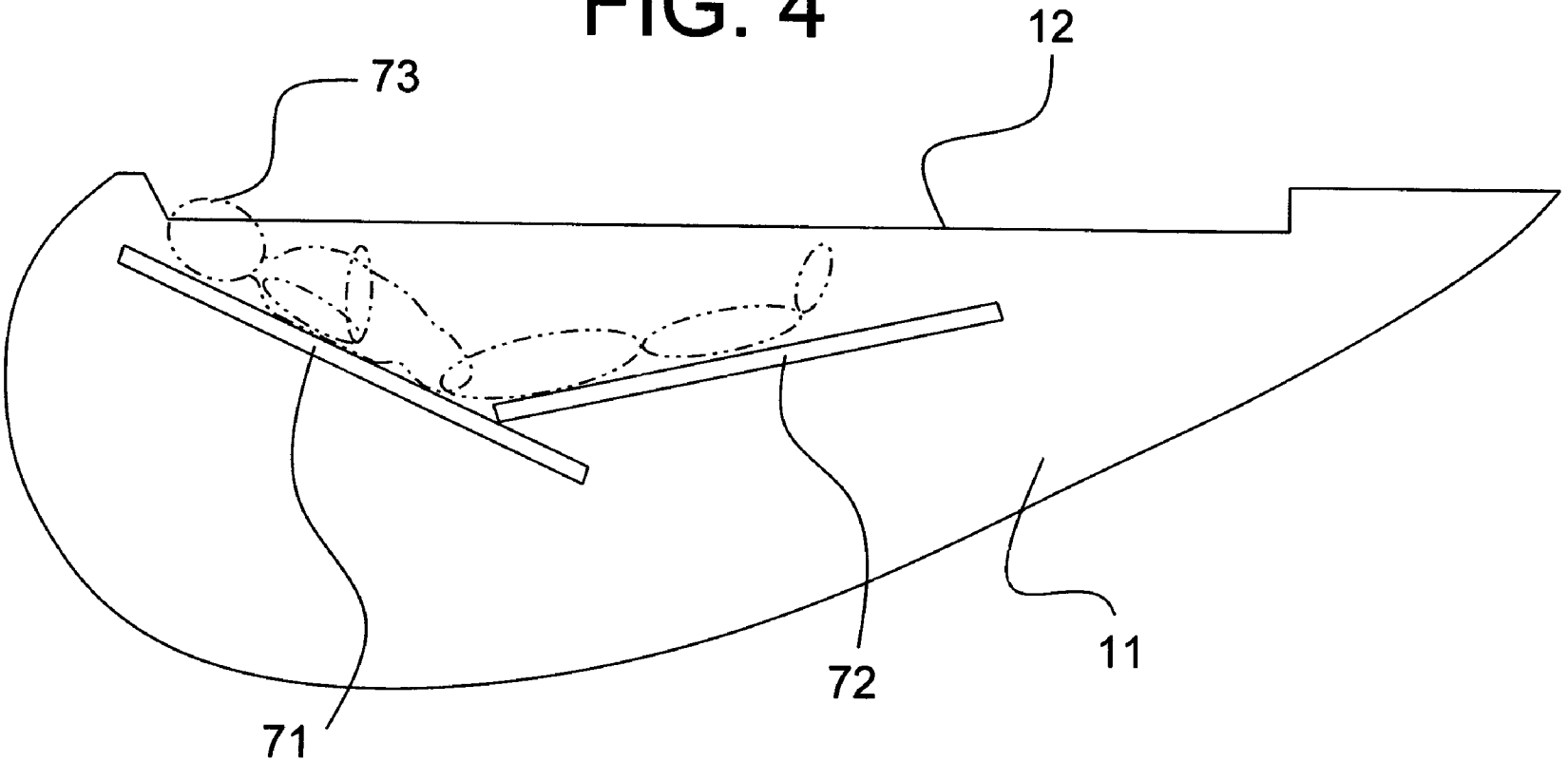
FIG. 4 depicts a side view of the invention
Figure 5:
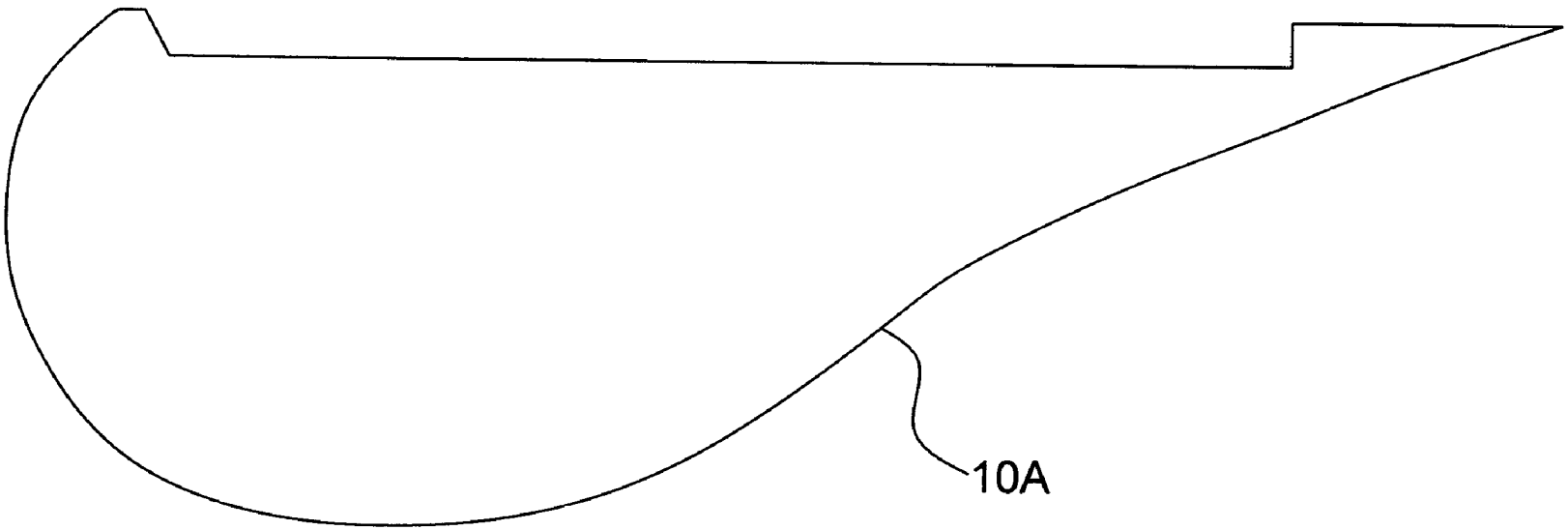
FIG. 5 depicts a side view of an alternative embodiment of the invention
Figure 9:
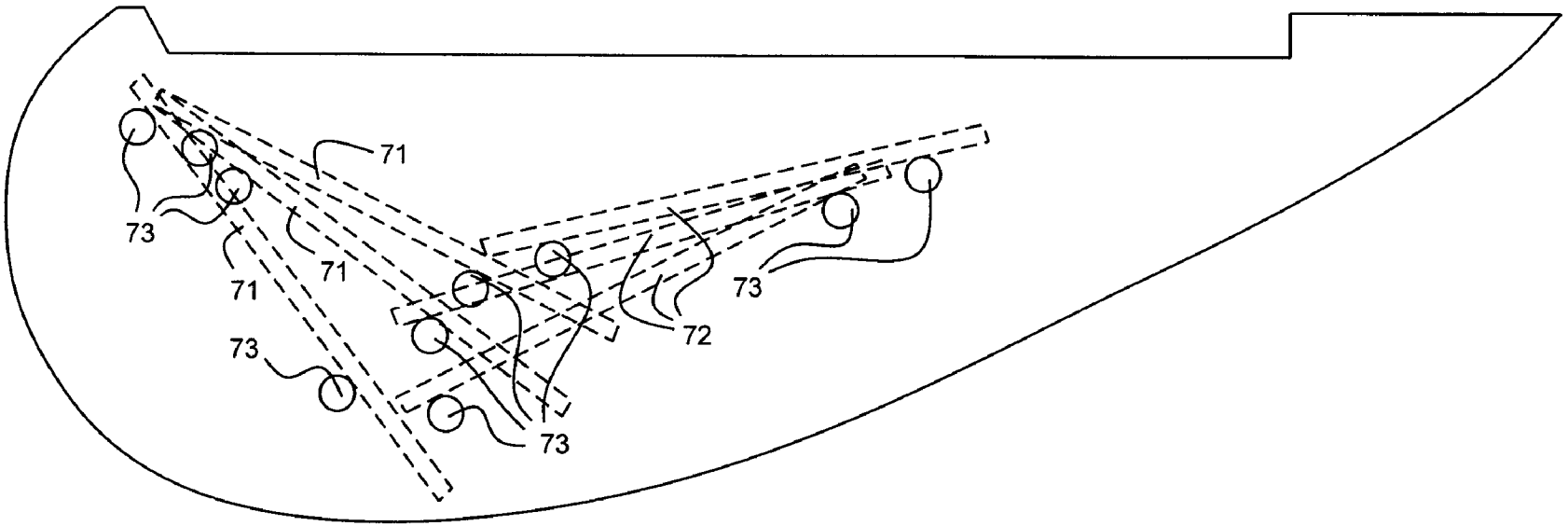
FIG. 9 depicts a side view of the invention

The cover comprises first and second cover portions 40, 60. The first and second cooperative support platforms 71, 72 are independently adjustable so as to support a human body of different sizes. As depicted in FIGS. 3 & 4, the platforms are arranged differently to accommodate different sizes. Moreover, a wide range of body sizes can be accommodated by adjusting the platforms (FIG. 9).

Each of the support platforms 71, 72 is releasably attached on both sides to the vertical side walls 11 by pegs, tabs, or hooks 73 (FIG. 9) whereby the platforms can be positioned in different arrangements. To facilitate adjustment for varying body lengths, separate diagrams or indicia can be marked on the inside of the vertical walls, each corresponding to differing lengths. One of skill in the art would appreciate that the adjustable support platforms could be employed in coffins of traditional rectangular shapes.

Figure 10:
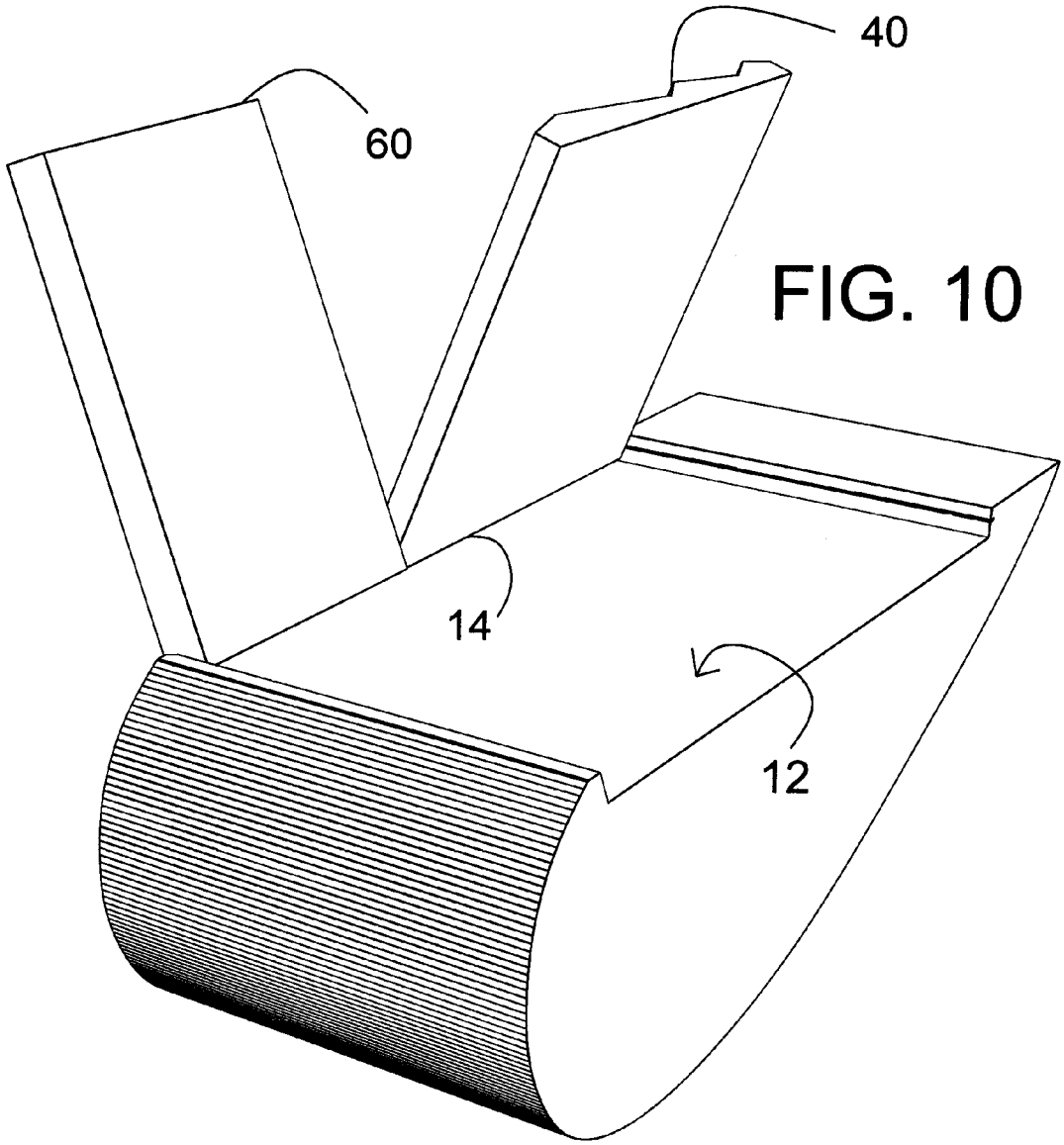
FIG. 10 depicts a perspective view of an alternative embodiment of the invention
Figure 11:
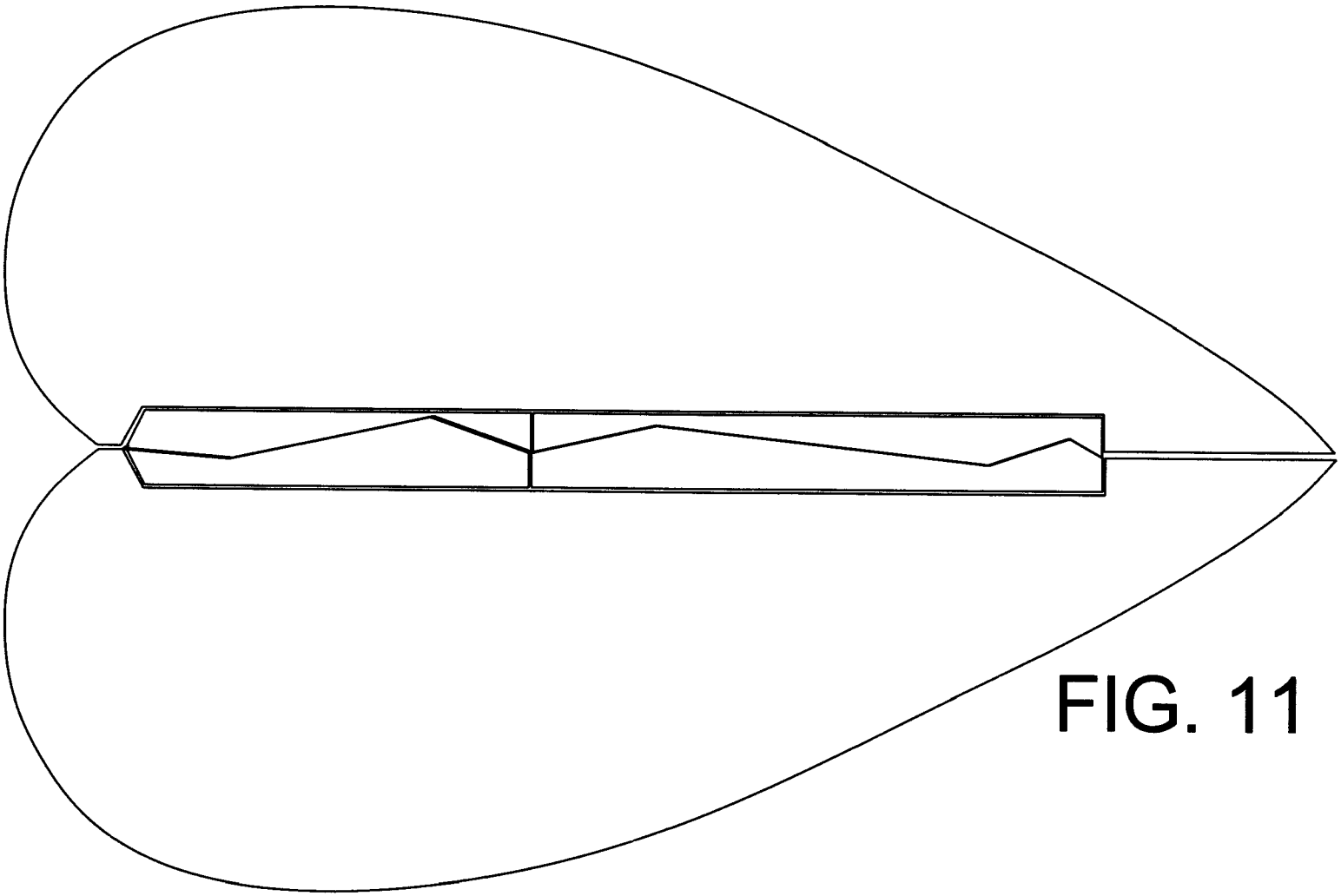
FIG. 11 depicts a side view of an alternative embodiment of the invention

The cover can be attached to the coffin using various methods. In one embodiment, a first end 51 of the first cover portion 60 is hingedly connected to a first end 42 of the second cover portion 40, a second end 43 of the second cover portion 40 is connected to a first end 13 of the opening 12 by tongue and groove means 30, and a second end 50 of the first cover portion 60 is releasably secured to a second end 15 of the opening by latch or clasp means. In another embodiment (FIG. 10), the first and second cover portions 40, 60 are each hingedly connected to one side 14 of opening 12.

Figure 6:
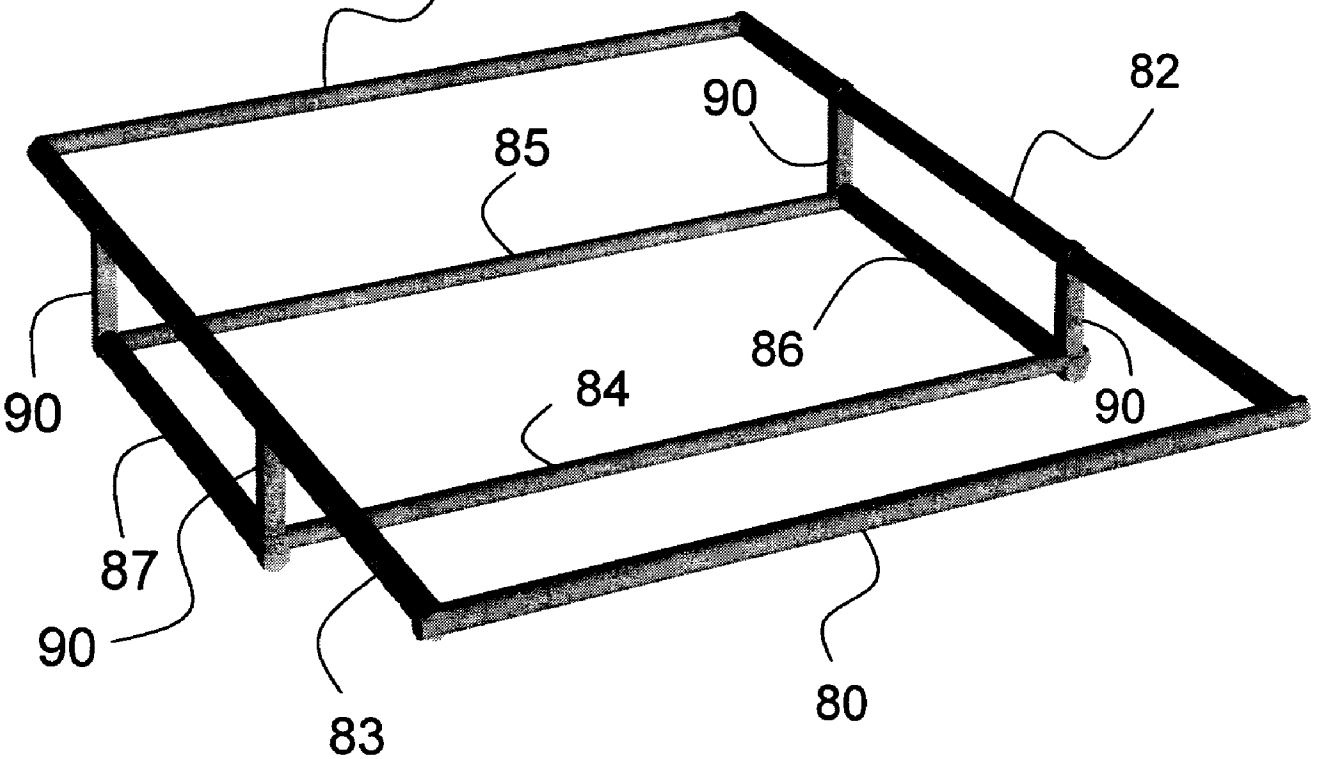
FIG. 6 depicts a perspective view of the invention
Figure 7:
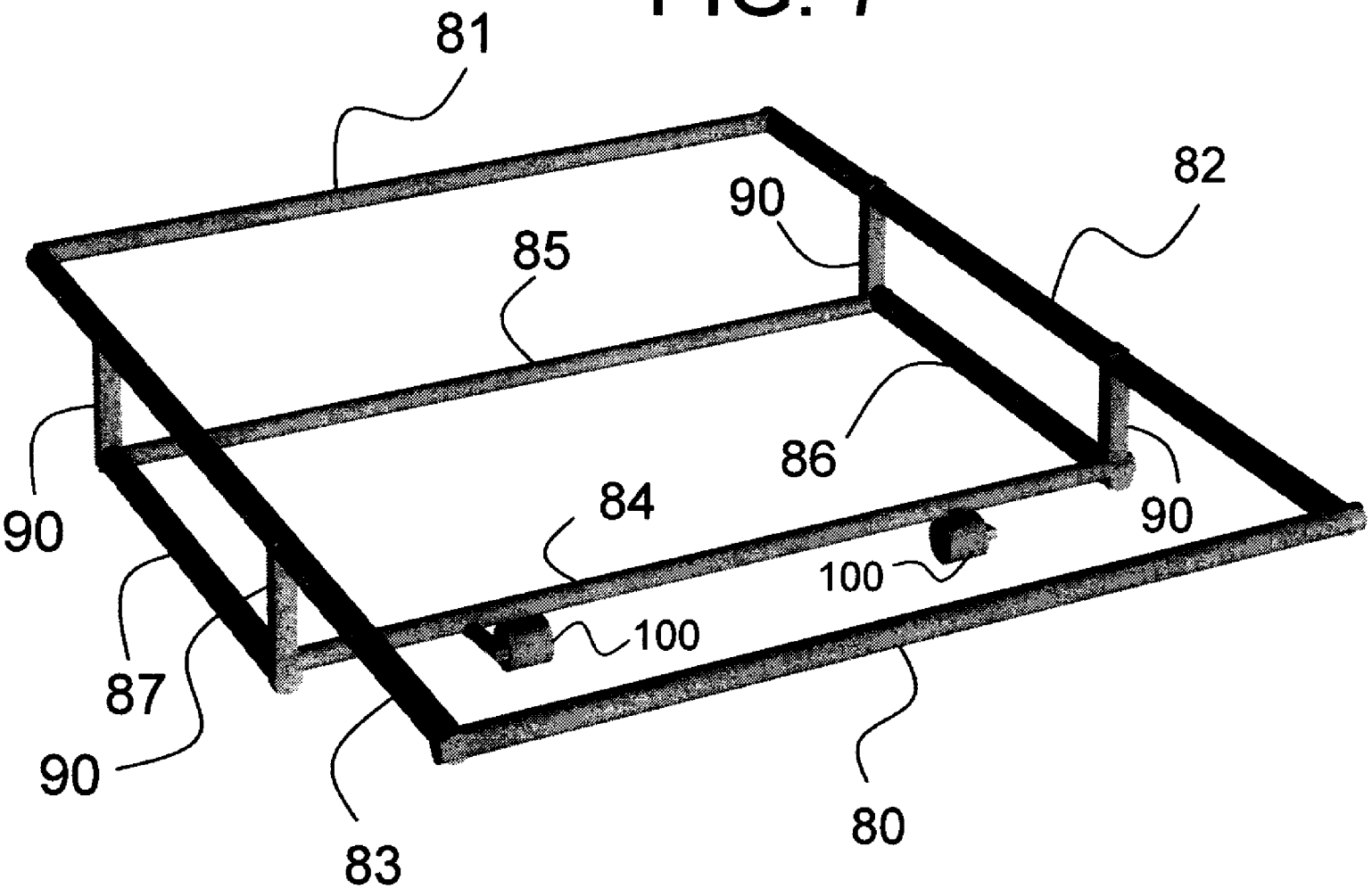
FIG. 7 depicts a perspective view of the invention

A cradle (FIGS. 6-8) is provided in some embodiments to facilitate holding the container in a fixed position. The cradle can be made of wood, metal, or any other material has similar properties. Additionally, brass or other materials having a decorative effect can be used.

The cradle is made of elongated rigid members 80-87 comprising, upper 80-83 and lower 84-87 rectangular support frames that are vertically displaced with respect to each other by rigid support posts 90. The lower support frame 84-87 is of less cross sectional area than the upper support frame 80-83 to accommodate curved surface 10.

Figure 8:
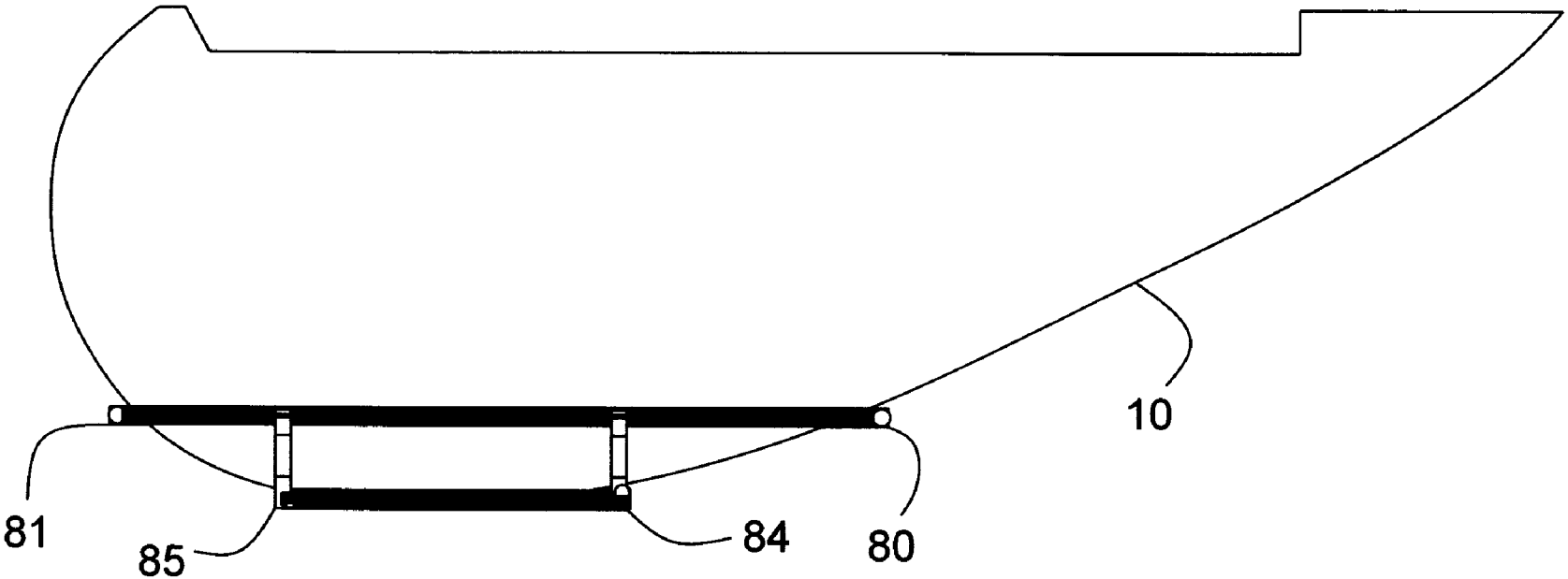
FIG. 8 depicts a side view of the invention

As shown in FIG. 8, the curved surface rests within each end of each 80, 81, 84, 85 of the support members. In one embodiment, side pieces 82, 83, of the upper support member are offset somewhat from the vertical side walls 11 to allow them to be used as handles for carrying the coffin. Alternatively, carrying handles can be attached to the sides 11. In one embodiment, rigid member 84 is displaced slightly higher vertically with respect to rigid member 85 to facilitate a snug fit to lower surface 10.

In one embodiment (FIG. 7), lower rectangular support frame 84-87 has two wheels 100 attached to member 84. The wheels are placed so as to be above the floor and only in contact with the floor when the cradle is tilted, whereby the cradle can be used to roll the coffin in transport.

Figure 12:
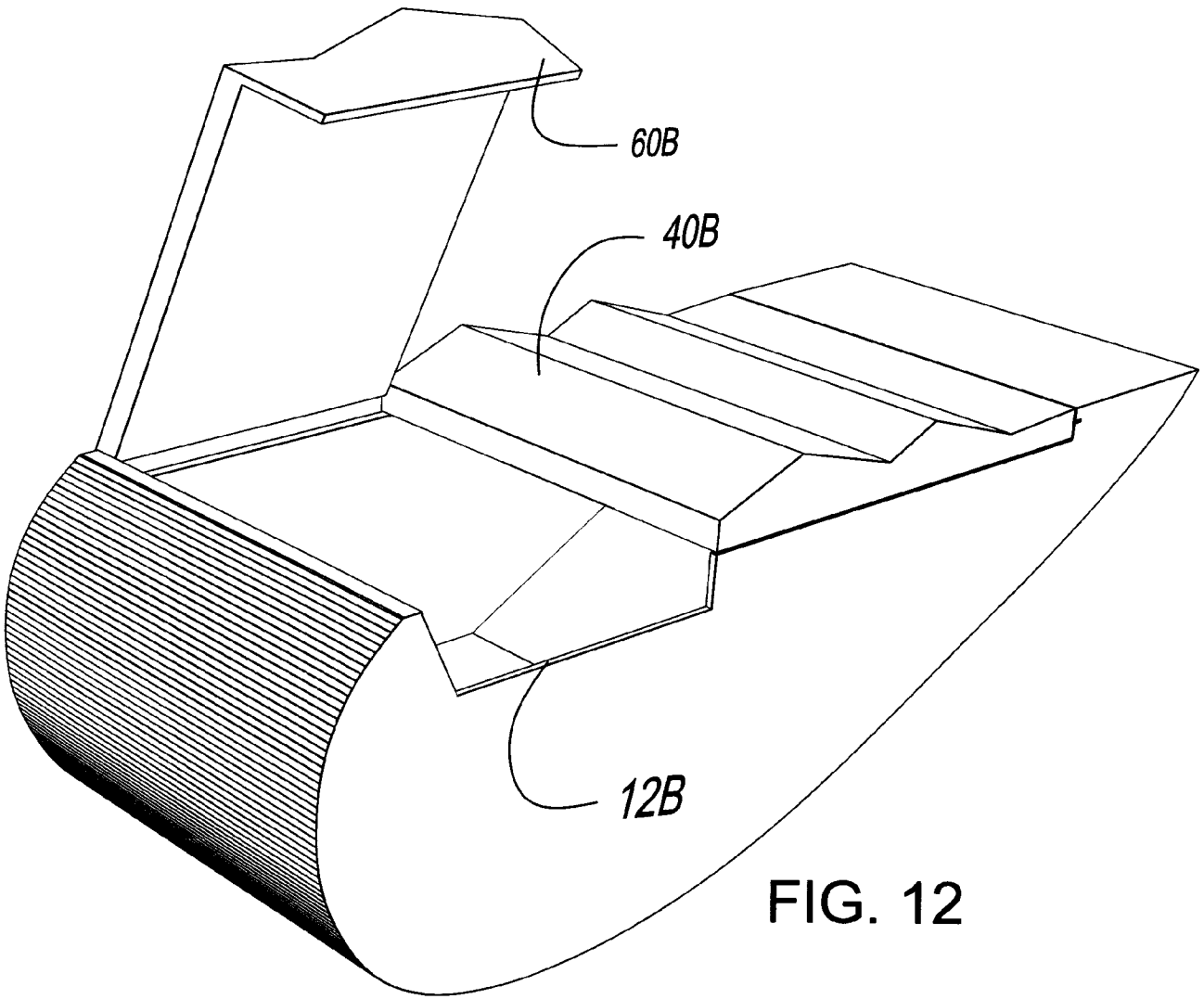
FIG. 12 depicts a perspective view of an alternative embodiment of the invention

In one embodiment (FIG. 12), one side of the coffin has a tapered portion 12B to facilitate better viewing the head of the deceased. Cover 60B is adapted to correspond to the profile of tapered portion 12B so the opening is completely sealed in the closed position.

Figure 13:
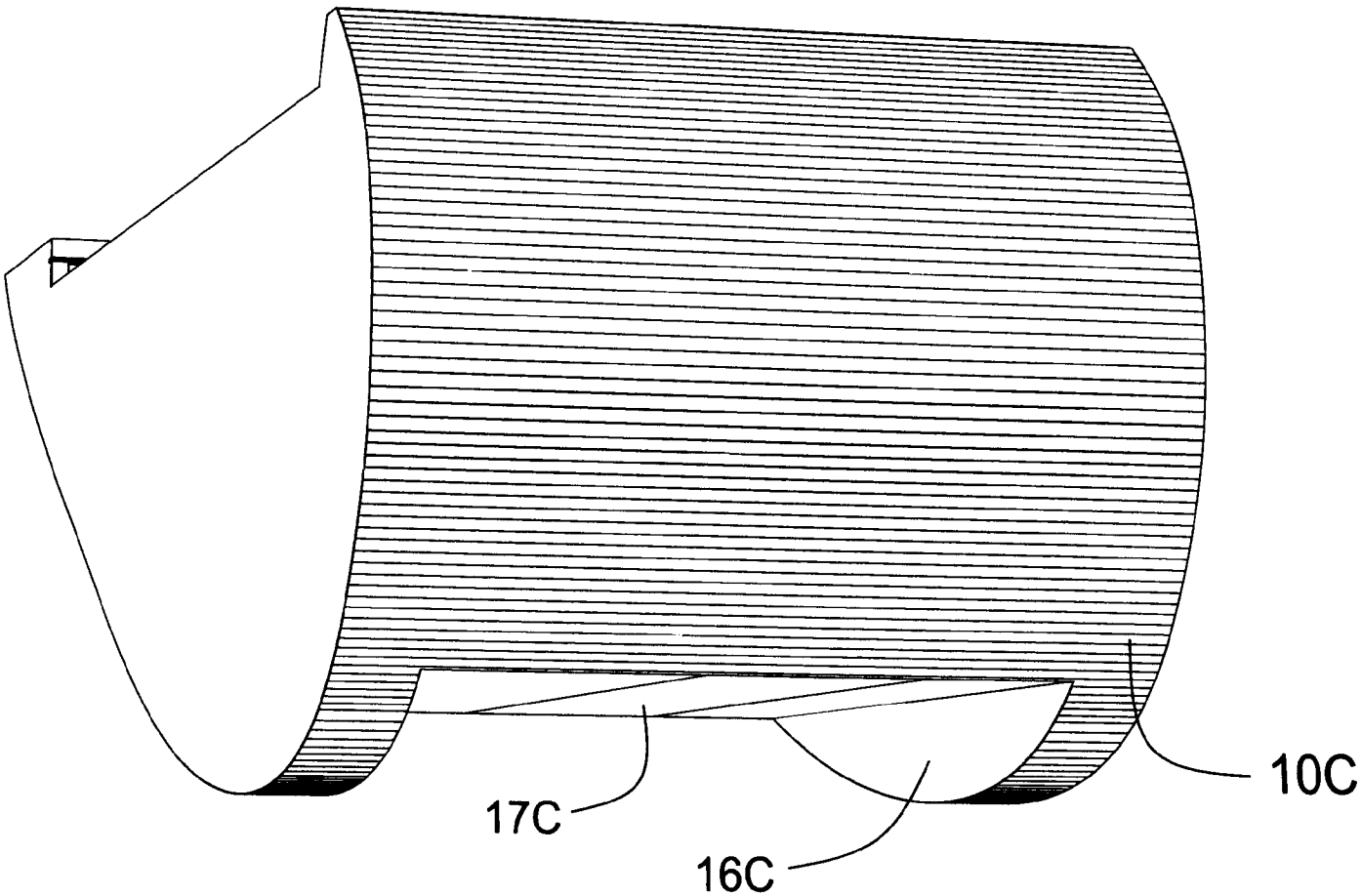
FIG. 13 depicts a perspective view of an alternative embodiment of the invention
Figure 14:
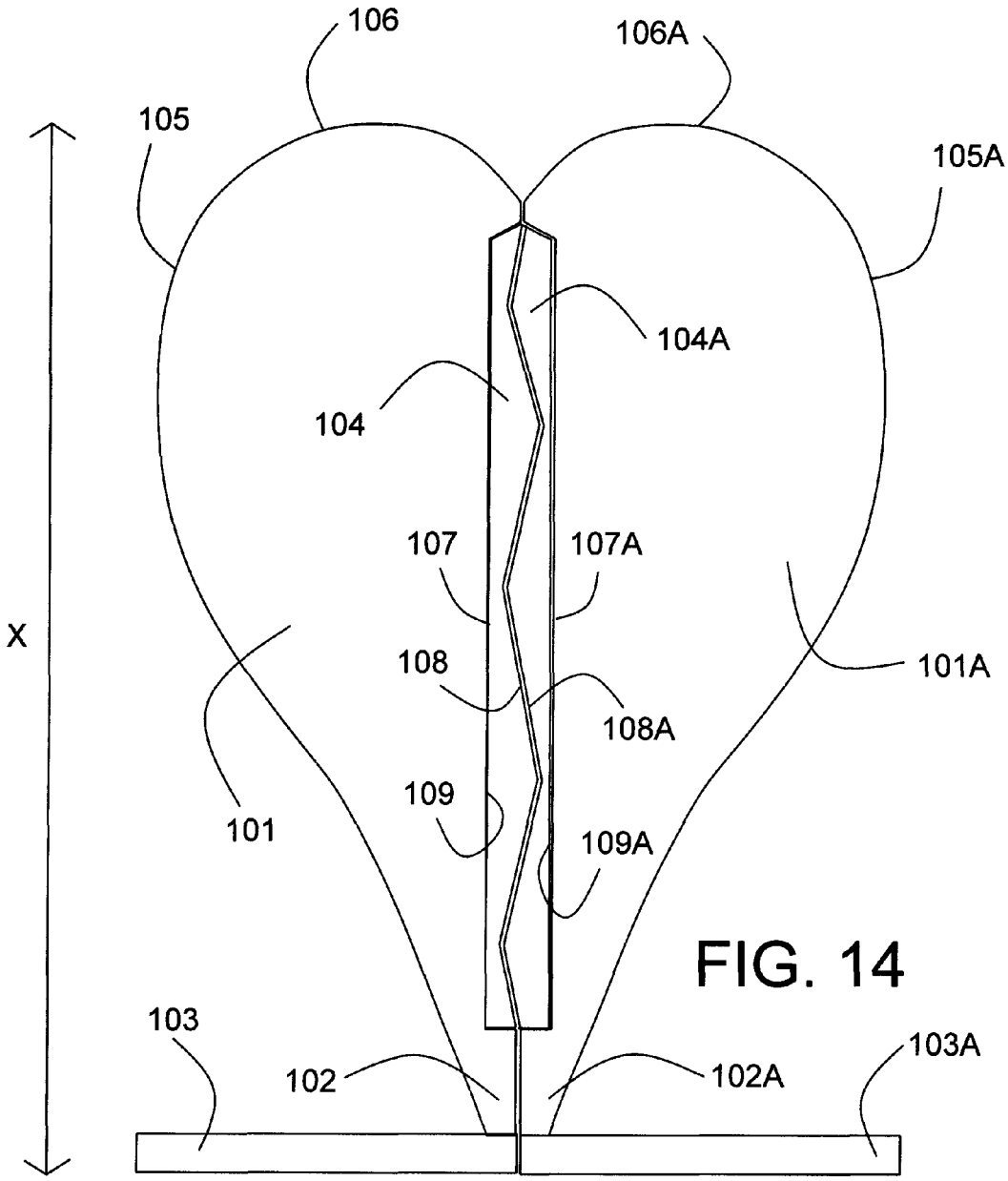
FIG. 14 depicts a side view of an alternative embodiment of the invention

In one embodiment (FIG. 13), the bottom portion of curved surface 10C of the coffin is adapted to have a recessed flat portion 17C to facilitate placement of the coffin on a preparation table. Curved surface 10C forms lobes 16C on either side of flat portion 17C. As depicted in FIG. 14, one embodiment of the present invention comprises an urn having: a curved outer surface 105 having upper and lower ends 106, 102 said lower end 102 being attached to a base member 103; two vertical side walls 101 attached to each side of said curved outer surface so as to form a container having an opening 107; a removable cover 104 having inner and outer surfaces 109, 108 and being attachable to said opening 107 adjacent said inner surface 109 whereby said container can be sealed; said base member 103 being essentially a slab and further being adapted to support said container and said cover in an upright position (as depicted in FIG. 14); said outer surface 108 of said removable cover having a jagged profile for abutting a complementary jagged outer surface 108A of a second urn thereby forming essentially a heart shape as viewed from the side when the two urns are abutted; the second urn further having a curved outer surface 105A having upper and lower ends 106A, 102A said lower end 102A being attached to a base member 103A; two vertical side walls 101A attached to each side of said curved outer surface so as to form a container having an opening 107A; a removable cover 104A having inner and outer surfaces 109A, 108A and being attachable to said opening 107A adjacent said inner surface 109A whereby said container can be sealed; said base member 103A being essentially a slab and further being adapted to support said container and said cover in an upright position (as depicted in FIG. 14). The base members 102, 102A are adapted to essentially complete an "L" shape when attached to the containers. The urns can alternatively be positioned as book ends.

In one embodiment, the urn is sized 12 inches ("x" in FIG. 14) vertically and 4 inches deep.

What is claimed is:

1. A pair of complementary coffins, each comprising:

a curved bottom surface for a support surface and two planar vertical side walls attached to each side of said curved bottom surface so as to form a container with an opening;

a removable cover having upper and lower surfaces and being attachable to said opening adjacent said lower surface whereby said container is sealed;

said upper surfaces of said removable covers of said coffins having complementary jagged profiles fitting together, in combination with said coffins, to form essentially a heart shape as viewed from a side.

2. A coffin comprising:

a curved bottom surface for a support surface;

2 planar vertical side walls attached to each side of said curved bottom surface so as to form a container having an opening;

a removable cover being attachable to said opening whereby said container can be sealed, said cover comprising first and second cover portions, a first end of said first cover portion being hingedly connected to a first end of said second cover portion, a second end of said second cover portion being connected to a first end of said opening by tongue and groove means, a second end of said first cover portion being releasably secured to a second end of said opening;

first and second cooperative support platforms being independently adjustable so as to support a human body of different sizes, each of said support platforms being releasably attached on both sides to said vertical side walls by pegs, tabs, or hooks whereby said platforms is positioned in different arrangements.

3. The coffin of claim 2 further comprising:

carrying handles affixed to each of said vertical sides.

4. The coffin of claim 2 further comprising:

a cradle for holding said container in a fixed position.

5. The coffin of claim 4 further comprising:

said cradle being made of elongated rigid members and further comprising, upper and lower rectangular support frames being vertically displaced with respect to each other by rigid support posts, said lower support frame being of less cross sectional area than said upper support frame, whereby said curved surface rests essentially tight within each said support frame.

6. The coffin of claim 5 further comprising:

said lower rectangular support frame having 2 wheels attached to one end, said wheels being placed so as to be above the floor and only in contact with the floor when said cradle is tilted, whereby said cradle rolls said coffin in transport.

7. The coffin of claim 5 further comprising:

the side rails of said upper support frame being offset from said vertical side walls to facilitate use as carrying handles.

8. The coffin of claim 2 further comprising:

carrying handles affixed to each of said vertical sides; a cradle for holding said container in a fixed position, said cradle being made of elongated rigid members and further comprising upper and lower rectangular support frames being vertically displaced with respect to each other by rigid support posts;

said lower support frame being of less cross sectional area than said upper support frame, whereby said curved surface rests essentially tight within each said support frame;

said lower rectangular support frame having 2 wheels attached to one end, said wheels being placed so as to be above the floor and only in contact with the floor when said cradle is tilted, whereby said cradle rolls said coffin in transport;

the side rails of said upper support frame being offset from said vertical side walls to facilitate use as carrying handles.

9. An urn for storing cremated remains, said urn comprising:

a curved vertical outer surface having upper and lower ends, said lower end being attached to a base member for a support surface;

2 planar vertical side walls attached to each side of said curved outer surface so as to form a container having an opening opposite said curved vertical outer surface for receiving the cremated remains;

a removable cover having inner and outer surfaces and being attachable to said opening adjacent said inner surface whereby said container is sealed;

said base member being essentially a slab and further being adapted to support said container and said cover in an upright position.

10. The urn of claim 9 wherein said outer surface of said removable cover having a jagged profile for abutting a complementary jagged outer surface of a second urn thereby forming essentially a heart shape as viewed from the side when the two urns are abutted;

the second urn having, a curved vertical outer surface having upper and lower ends, said lower end being attached to a base member for a support surface;

2 vertical side walls attached to each side of said curved outer surface so as to form a container having an opening opposite said curved vertical outer surface for receiving the cremated remains;

a removable cover having inner and outer surfaces and being attachable to said opening adjacent said inner surface whereby said container is sealed;

said base member being essentially a slab and further being adapted to support said container and said cover in an upright position.

* * * * *